US012799840B2

(12) United States Patent
Miller et al.

(10) Patent No.: US 12,799,840 B2
(45) Date of Patent: Nov. 17, 2026

(54) SEAL ASSEMBLY, DOWNHOLE TOOL AND SYSTEM

(71) Applicant: Baker Hughes Oilfield Operations LLC, Houston, TX (US)

(72) Inventors: Wade Miller, Broken Arrow, OK (US); Ronald Jon Garr, Inola, OK (US); Daniel Steven McWherter, Tulsa, OK (US); Jason Wade Edwards, Tulsa, OK (US); Troy Warriner, Tulsa, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 55 days.

(21) Appl. No.: 18/598,437

(22) Filed: Mar. 7, 2024

(65) Prior Publication Data

US 2024/0309724 A1 Sep. 19, 2024

Related U.S. Application Data

(60) Provisional application No. 63/498,727, filed on Apr. 27, 2023, provisional application No. 63/452,791, filed on Mar. 17, 2023.

(51) Int. Cl.

| | |
|---|---|
| ***E21B 33/08*** | (2006.01) |
| ***E21B 33/10*** | (2006.01) |
| ***E21B 34/14*** | (2006.01) |

(52) U.S. Cl.

CPC ..... *E21B 33/10* (2013.01); *E21B 34/14* (2013.01); *E21B 2200/01* (2020.05); *E21B 2200/05* (2020.05)

(58) Field of Classification Search

CPC ..... E21B 33/10; E21B 34/14; E21B 2200/01; E21B 2200/05

(Continued)

(56) References Cited

U.S. PATENT DOCUMENTS 4,283,062 A 8/1981 Catanzaro et al.
4,588,030 A * 5/1986 Blizzard ..... E21B 33/1292 277/342

(Continued)

FOREIGN PATENT DOCUMENTS

WO 2020068642 A1 4/2020

OTHER PUBLICATIONS

Flanged Spring Energized PTFE Rotary Seal; Gallagher Fluid Seals, Inc. 7 pages. Retrieved from the internet on Mar. 23, 2023: https://www.gallagherseals.com/flanged-spring-energized-ptfe-rotary-seal.html.

(Continued)

*Primary Examiner* — Tara Schimpf
*Assistant Examiner* — Patrick F Lambe
(74) *Attorney, Agent, or Firm* — Baker Hughes Patent Organization

(57) ABSTRACT

A seal assembly including a seal subassembly disposed upon a seal subassembly configured to hold pressure, a first load member having a first side disposed adjacent a first side of the seal subassembly, the first load member configured to engage the seal subassembly such that the first load member independently has a limited axial movement capability in both longitudinal directions along the seal assembly, and a first energizer adjacent a second side of the first load member, the first load member isolating the first energizer from mechanical loading in a direction opposite a direction of bias of the first energizer. A downhole tool including a housing, and an actuator disposed in the housing, the actuator including a seal assembly. A wellbore system including a borehole in a subsurface formation, a string disposed in the borehole, a downhole tool disposed within or as part of the string and including the seal.

23 Claims, 16 Drawing Sheets

(58) Field of Classification Search
USPC ..... 166/332.8
See application file for complete search history.

(56) References Cited

U.S. PATENT DOCUMENTS

| | | | | |
|---|---|---|---|---|
| 5,056,757 | A | 10/1991 | Wood | |
| 5,230,498 | A * | 7/1993 | Wood | F16J 15/186 137/553 |
| 5,833,018 | A | 11/1998 | Von | |
| 6,173,785 | B1 | 1/2001 | Adams et al. | |
| 6,203,020 | B1 * | 3/2001 | Mireles, Jr. | E21B 33/1216 277/339 |
| 9,341,039 | B2 | 5/2016 | Galle et al. | |
| 2003/0205389 | A1 * | 11/2003 | Deaton | E21B 34/10 166/321 |
| 2007/0235191 | A1 | 10/2007 | Loughlin | |
| 2014/0084199 | A1 | 3/2014 | Newlands et al. | |
| 2015/0102247 | A1 | 4/2015 | Leboeuf et al. | |
| 2017/0370175 | A1 | 12/2017 | Hiorth | |
| 2021/0340837 | A1 * | 11/2021 | Fox | E21B 34/14 |
| 2024/0309723 | A1 | 9/2024 | Miller | |
| 2024/0309724 | A1 * | 9/2024 | Miller | E21B 34/14 |

OTHER PUBLICATIONS

Flanged V-Spring-loaded-high-pressure rotary seal for spinning bore VS-PS19A; American High Performance Seals; 6 pages; retrieved from the internet Mar. 23, 2023: https://ahpseals.com/product/vs-ps19a-3/.

Notification of Transmittal of the International Search Report and the Written Opinion of the International Searching Authority, or the Declaration; PCT/US2024/020048; Mail date: Jul. 9, 2024: 10 pages.

Notification of Transmittal of the International Search Report and the Written Opinion of the International Searching Authority, or the Declaration; PCT/US2024/020138; Mail date: Jun. 28, 2024; 11 pages.

* cited by examiner

SEAL ASSEMBLY, DOWNHOLE TOOL AND SYSTEM

CROSS REFERENCE TO RELATED APPLICATIONS

This application claims the benefit of an earlier filing date from U.S. Provisional Application Ser. No. 63/452,791 filed Mar. 17, 2023, and U.S. Provisional Application Ser. No. 63/498,727 filed Apr. 27, 2023, the entire disclosure of which is incorporated herein by reference.

BACKGROUND

In the resource recovery and fluid sequestration industries, sealing is a significant issue. Seal assemblies are created to allow for pressure actuation of myriad devices and pressure containment in myriad others. Many work quite well but there is always room for improvement. In some seal assemblies, unidirectional seals are used to energize other seals. This works well also but sometimes with pressure reversals, such unidirectional seals may be deleteriously affected. Since pressure reversals are common in the industries mentioned, the art is always receptive to alternative configurations that reduce drawbacks.

SUMMARY

An embodiment of a seal assembly including a seal subassembly configured to hold pressure, a first load member having a first side disposed adjacent a first side of the seal subassembly, the first load member configured to engage a recess in one of a central member radially inwardly of the seal subassembly or a housing radially outwardly of the seal subassembly such that the first load member independently has a limited axial movement capability in both longitudinal directions along the seal assembly, and a first energizer adjacent a second side of the first load member, the first load member isolating the first energizer from mechanical loading in a direction opposite a direction of bias of the first energizer.

An embodiment of a downhole tool including a housing, and an actuator disposed in the housing, the actuator including a seal assembly.

An embodiment of a wellbore system including a borehole in a subsurface formation, a string disposed in the borehole, and a downhole tool disposed within or as a part of the string and including the seal.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
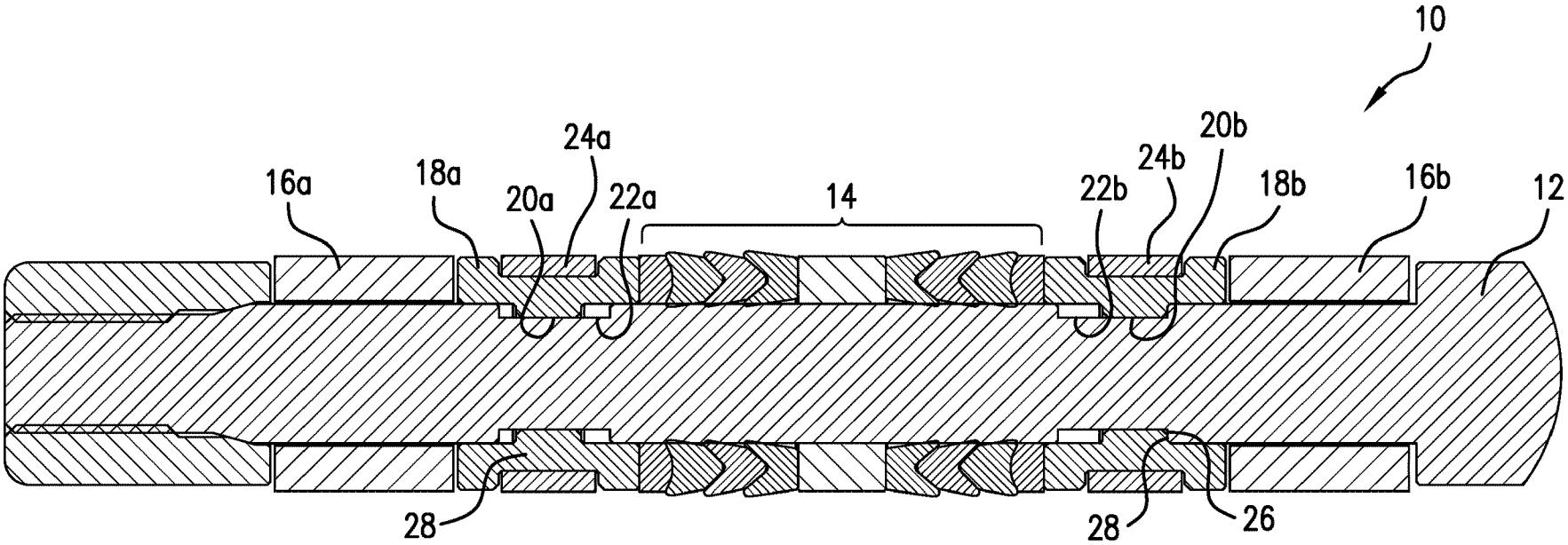
FIG. 1 is a sectional view of a seal assembly as disclosed herein in a first position.

Referring to FIG. 1, a seal assembly 10 is illustrated. The illustration puts the seal assembly 10 on a central member 12 that is illustrated as a piston rod mandrel but it is to be understood that the mandrel 12 may also be a tubular member making the seal assembly 10 more of an annular seal. The seal assembly 10 includes a seal subassembly 14 comprising a number of elements that may be formed into a single piece or may simply be stacked. The elements of the subassembly 14 may be such as chevron seals or similar and may be formed of materials such as Polyether Ether Ketone, elastomers, plastics, etc. In alternate embodiments, the subassembly could also include at least one elastomeric element such as an O-Ring or a T-Seal that may be intended for bi-directional sealing. The subassembly 14 is configured such that its pressure containing capability is enhanced upon being mechanically energized. This can be particularly beneficial in conditions wherein low pressure differentials exist across the seal assembly 10. In an embodiment, when subassembly 14 is mechanically energized, it will seal a pressure associated with movement of the mandrel 12. The mechanical energy may in embodiments come from an energizer 16*a* or 16*b* on one or the other axial side of the seal assembly 10. Energizers include unidirectional seals, springs (such as coil springs, cone washers, elastomers, etc.), a plurality of magnets arranged to create a mechanical load in a direction, etc. Each energizer is configured to bias in a direction toward the subassembly, energizing the same. In a case there the energizer is a unidirectional seal, each unidirectional seal 16 is configured to hold pressure from a direction toward the seal subassembly 14 and relieve pressure in a direction away from subassembly 14. Where pressure is experienced by a unidirectional seal 16 toward the subassembly 14, that unidirectional seal will exert a mechanical force through a load member 18*a* or 18*b* into the subassembly 14, energizing the same to seal against a bore of a housing (not shown). In the event, the energizer 16 does not comprise a seal, the energy is provided in ways other than pressure, such as by spring force or magnetic force. Ultimately, the subassembly 14 is still energized.

Adjacent the energizers 16 are load members 18 (illustrated as 18*a* and 18*b*). Load members 18 are configured individually for limited longitudinal movement. This means that each load member 18 is able to move longitudinally of the mandrel 12 by a limited amount in both longitudinal directions. This may be occasioned by a radial projection 20 (20*a*, 20*b*) that extends radially inwardly from a body 21 of the load members 18. As such, a load path through a load member 18 limits load through the energizer 16 or the subassembly 14 based upon the limited longitudinal movement potential of the load members 18. The construction as set forth herein ensures that the associated energizer 16, while able to be a part of a mechanical load path toward the subassembly 14, is isolated from mechanical loading in a direction opposite the direction of bias and/or sealing. It is to be understood that the term "isolated" is intended to mean that at least some of the mechanical load path that would otherwise be borne through the energizer 16 is not borne through the energizer 16 but rather is borne through the load member 18 and the mandrel 12. In other words, the energizer 16 is not a full participant in the mechanical load path in a direction opposite the direction of bias and/or sealing of the respective energizer. The interruption of mechanical load path for each respective energizer, in a direction opposite the direction of bias and/or sealing of the respective energizer, is occasioned by the respective load member 18*a* or 18*b* transferring the mechanical path coming from an opposing side of the seal assembly 10 to the mandrel 12 prior to reaching the energizer 16*a* or 16*b*, respectively. One of ordinary skill in the art will appreciate the negative consequences associated with overloading an energizer 16 in the reverse direction (in the case of a unidirectional seal, its non-sealing or venting direction). Overloading an energizer in the reverse direction commonly results in a yielding of its original shape and a degradation of its performance-especially its performance in the presence of a low differential pressure acting across the seal. Notably, in conventional multi-element rod piston seal assemblies, energizers serve two fundamental purposes: First, the energizers serve to help energize the other elements of the seal assembly, such as vee rings. Second, energizers serve as an augmenter of the seal subassembly 14 or in the case of a unidirectional seal energizer 16 as the primary sealing element against low differential pressure acting across the seal assembly 10. This is arguably the most important role of the energizer given that the elements without a mechanical energizer (such as vee rings) are commonly unable to effectively seal against low differential pressures on their own due to their reliance upon pressure energizing to establish the required contact forces for sealing. The mechanical energizing feature of the energizer (e.g. its spring force or its internal spring, o-ring, structural shape, etc.) generates sufficient contact forces upon installation within the bore (due to squeeze) to seal off against low differential pressures. In environments with low differential pressure acting across a seal assembly, an energizer that has been overloaded in the reverse direction may perform poorly due to shape change. In addition, a yielded shape of an energizer 16 will be much more vulnerable to damage with continued reverse pressure loading. In the case of a spring force, this may be due to cyclic loading. In the case of a unidirectional seal, this is due to its original "venting" capability (i.e. venting reverse pressure) being degraded or eliminated altogether by the shape change. In other words, without being able to effectively vent reverse pressure, the unidirectional seal may suffer extrusion damage in the reverse direction given its original design was not intended for that capability.

As noted above, and still referring to FIG. 1, the load members 18 include, in an embodiment, a radial projection 20 that is slidably received in a recess 22 in the mandrel 12. The projections 20 and the recess 22 may be annularly complete or annularly discontinuous. In some embodiments, the recess 22 is a groove. It will be appreciated that the recess 22 exhibits an axial length that is greater than an axial length of the corresponding projection 20. This is what allows the load ring 18 to axially translate with changing pressure directions and therefore have the effects it is configured to have while also being of limited longitudinal movement relative to the mandrel in both longitudinal directions. In an embodiment, the load members 18 are multipart structures retained with a retainer ring 24 (24*a*, 24*b*). In such embodiment, the retainer ring 24 may be configured as a split ring that is split in one location (i.e. a C shaped ring) and snaps over the multipart load member 18 to retain and bias the load member towards recess 22. Retainer ring 24 can also be configured with more than one split and held together with the use of a high viscosity grease (national lubricating grease institute NLGI of 2 or higher) upon assembly. In some embodiments, the one or more retainer rings 24 can be sized to fit the bore of the housing (not shown) within which the mandrel installs as a centralizing bearing feature for the seal assembly 10. In such instances, retainer ring 24 may be formed of relatively soft non-metallic materials such as Polyether Ether Ketone, Polytetrafluouroethylene, or other thermoplastics to minimize the potential for wear or damage to the bore of the housing (not shown) that could result from contact with the retainer ring 24 during movement of the mandrel 12. Placing centralizing features such as the combination of load members 18 and retainer rings 24 in multiple points along the length of a seal assembly 10 ideally centralizes the seal assembly 10 and leads to better seal performance by maintaining uniform and consistently small extrusion gaps in critical areas of the seal (such as the interface between elements contained in seal subassembly 14 and the interface of said elements with the bore of the housing). Multi-point centralization as discussed also greatly enhances a seal assembly's ability to withstand potential side loading (or uneven mechanical loading) from the mandrel 12 during normal operation of the downhole tool. This enhancement significantly improves seal performance, and is especially useful for downhole tubular applications when the mandrel 12 imparts off-axis loading to a sleeve, ball, or other member, which in-turn places the mandrel 12 in bending and results in the side loading of seal assemblies.

Figure 2:
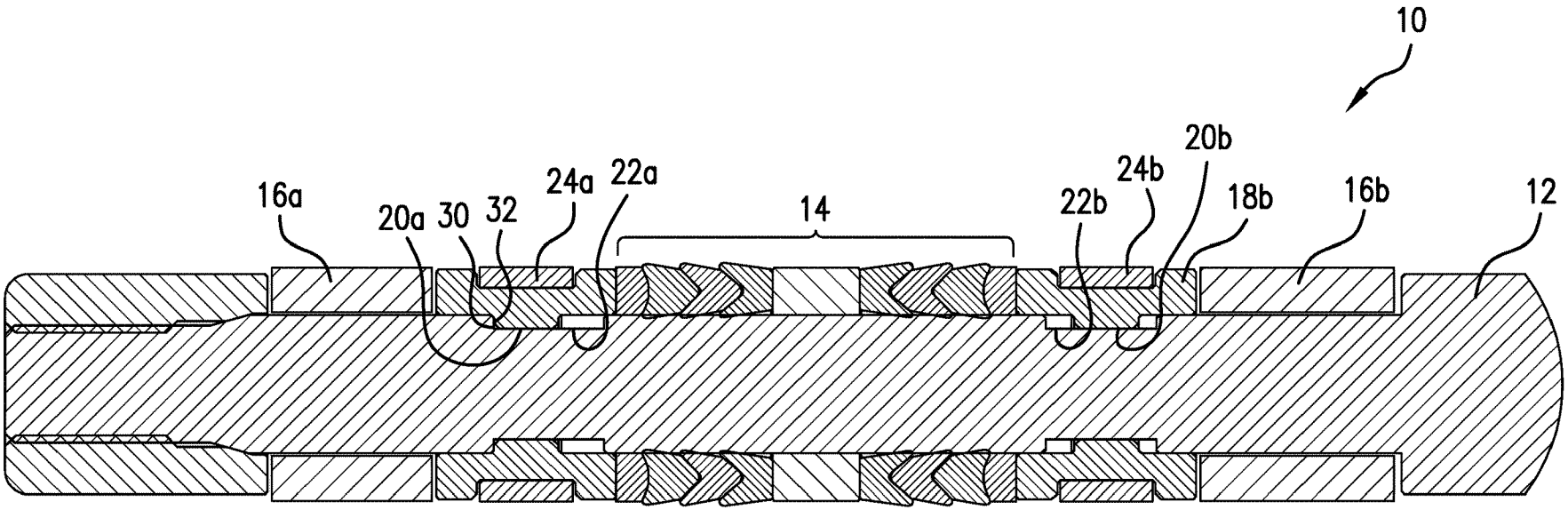
FIG. 2 is the same view as FIG. 1 but with the seal assembly in a reverse pressured position.

Referring to FIGS. 1 and 2 simultaneously, the mechanical paths may be appreciated. In FIG. 1, the seal assembly 10 is illustrated energized by being spring biased and/or by increased pressure from the left of the figure. In the case of a pressure augmented embodiment, the energizer 16 is a unidirectional seal. Unidirectional seal 16*a* is loaded by pressure (from the left of figure as noted) in the direction in which it is intended to hold pressure. The pressure then results in seal 16*a* moving to the right of FIG. 1 toward the seal subassembly 14. The motion of unidirectional seal 16*a* is directly transferred to load member 18*a* through contact with the seal 16*a* and provides the first step of the mechanical pathway through the seal assembly 10 during pressure loading from the left of FIG. 1 (the direction of sealing of the unidirectional seal 16*a*). The load member 18*a* slides within the recess 22*a* and so transfers the mechanical load to seal subassembly 14. The same mechanical load is also transferred to load member 18*b*, which correspondingly slides to the right of FIG. 1. The motion of load member 18*b* is limited by recess 22. Specifically, a load shoulder 26 of radial projection 20 is brought into contact with a limit shoulder 28, whereby the mechanical load path is transferred directly into the mandrel 12. At this point, the seal subassembly 14 is energized. It will be appreciated that unidirectional seal 16*b* (or any of the energizers 16*b*), is NOT in the mechanical load path for pressure from the left side of FIG. 1. Rather it is isolated from that mechanical load path by the transfer of all of that mechanical load from that direction into the mandrel 12 by the load member 18*b*. Turning to FIG. 2, it will be understood that the pressure is now from the right side of the figure. Each of the statements above apply in the opposite direction but the mechanical load path that reaches the load member 18*a* from pressure on the right of FIG. 2, is transferred to the mandrel 12 through contact between a load shoulder 30 and a limit shoulder 32. Again, the unidirectional seal (or other energizer) that faces a direction opposite the prevailing pressure, 16*a* in this case, is isolated from the mechanical load path in the mentioned direction. For each case, that of FIG. 1 and that of FIG. 2, the unidirectional seal that is pressure loaded in a direction opposing that in which it is configured to hold pressure will "burp" (i.e. vent) that pressure and not experience a mechanical load in a direction opposite the direction of sealing of the respective unidirectional seal. Isolating the respective unidirectional seals 16*a* or 16*b* avoids damage to these seals that could otherwise occur from overloading in their respective non-sealing direction and necessitate maintenance or replacement.

Figure 3A:
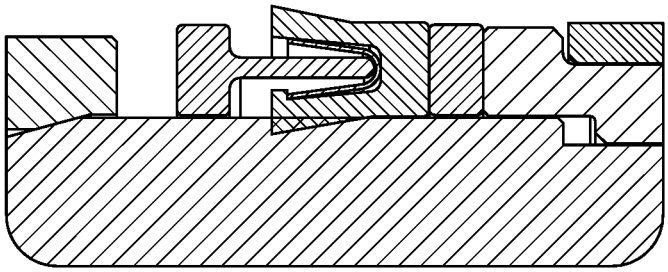
FIGS. 3A-3F are enlarged views of a portion of FIG. 1 that illustrate different embodiments of the energizer employable in FIG. 1.
Figure 3B:
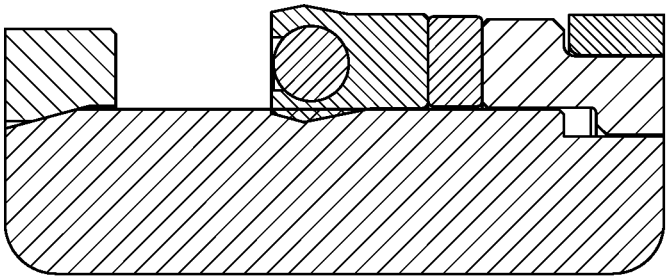
Figure 3C:
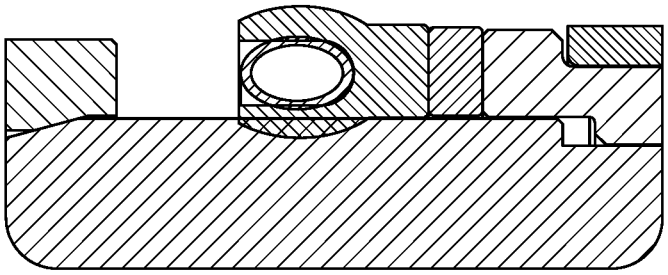
Figure 3D:
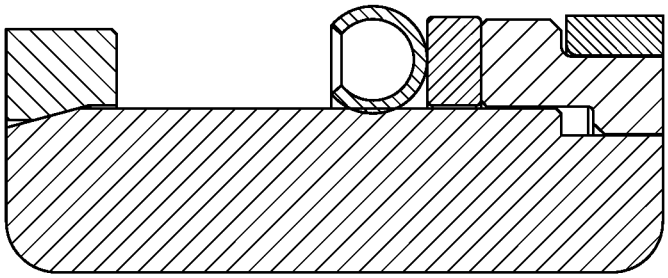
Figure 3E:
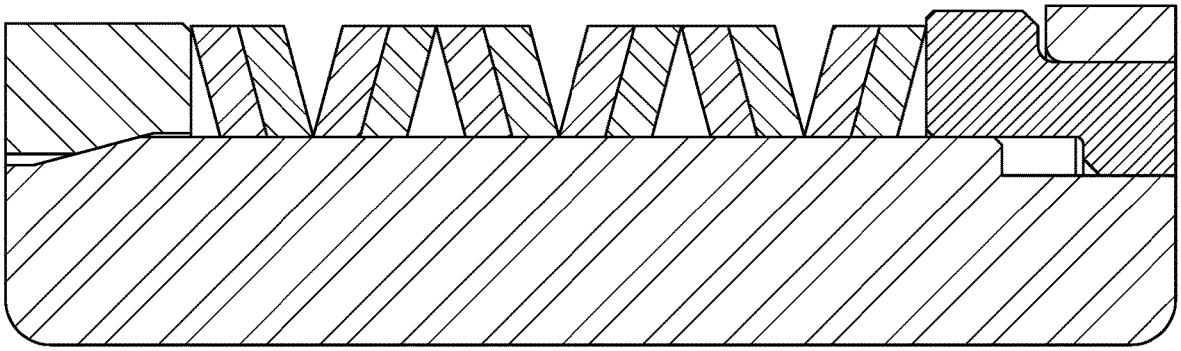
Figure 3F:
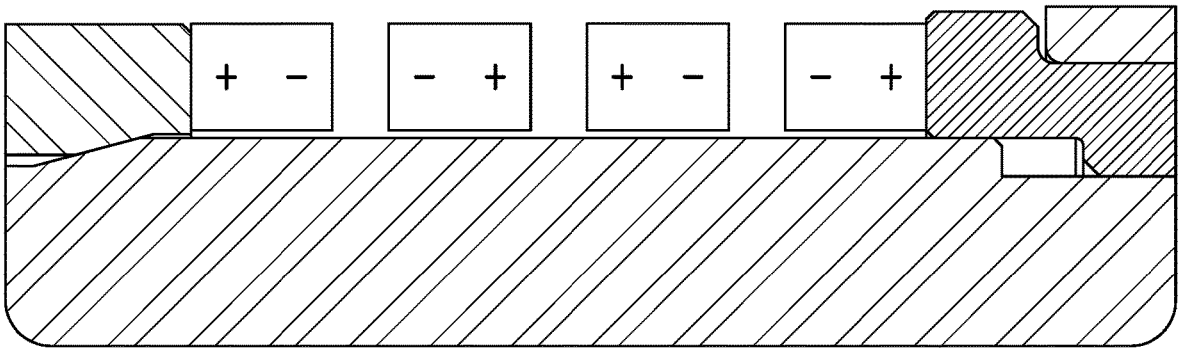

Referring to FIGS. 3A-3F, several types of energizer are illustrated that may be employed in connection with this disclosure. They include in order: a spring energized seal with a cantilever type spring and a supporting platform sometimes known as a hat ring (FIG. 3A); a spring energized seal with a coil-type spring (FIG. 3B); a spring energized seal with an o-ring (FIG. 3C); a metallic C-seal (FIG. 3D); stacked cone washers (FIG. 3E); and magnets (FIG. 3F). It is to be appreciated that these are merely nonlimiting examples of possible energizers that may be used in the seal assembly disclosed herein. One of ordinary skill in the art is familiar with each of these types of energizers and each of them is readily commercially available.

Figure 4:
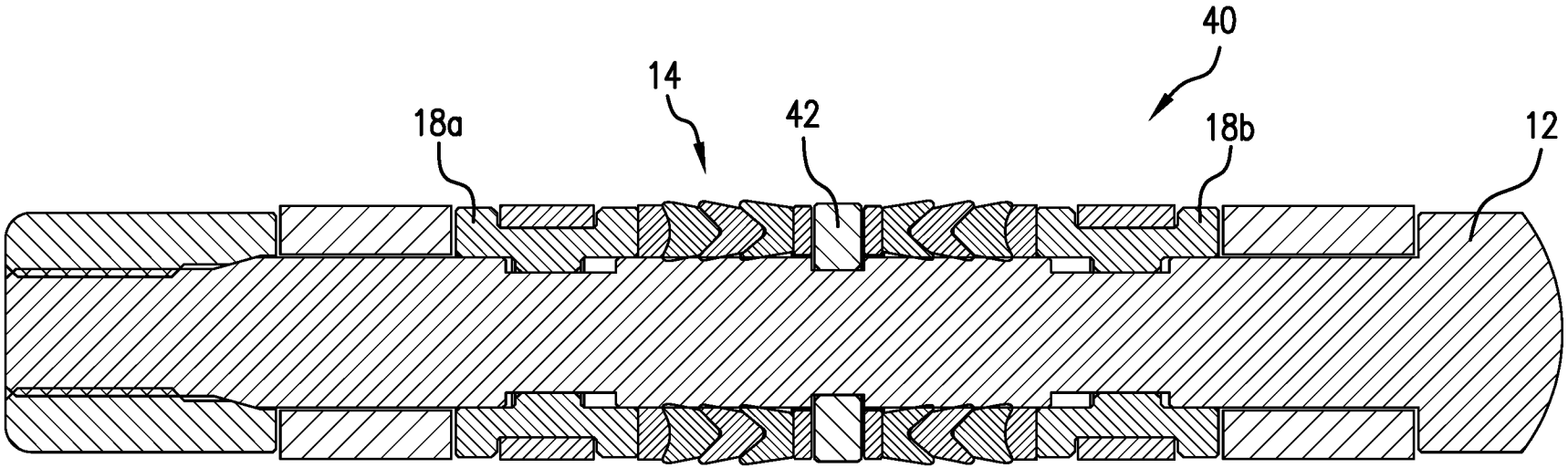
FIG. 4 is a view similar to FIG. 1 but including a feature to axially fix a portion of the seal assembly to a mandrel.

Referring to FIG. 4, an alternate embodiment of a seal assembly, designated 40, is illustrated. This embodiment uses all of the components of the embodiment of FIGS. 1 and 2 but adds another component in the form of a subassembly locator 42 that locates the seal subassembly 14 relative to the mandrel 12 (which as in the previous embodiment may be a rod piston type mandrel or may be a tubular type mandrel). The locator 42 eliminates the need for the seal subassembly 14 to translate prior to being mechanically energized. It will be recalled that the mechanical loading the subassembly used to energize in FIG. 1 occurs after the load shoulder 26 contacts limit shoulder 28. Further movement of load member 18*a* from unidirectional seal (or other energizer) 16*a*, compresses the subassembly 14, thereby energizing the same. In the embodiment of FIG. 4 however, the subassembly 14 (or at least the part of it on the side of the locator 42 that is being made a part of a mechanical load path based upon pressure, spring force (coil spring, cone washer, gas spring, magnetic fields, etc. applied from that side for the seal assembly 40, is energized against the locator 42 which thereby transmits load to the mandrel 12. The opposing load member 18*b* may not even reach the respective limit shoulder unless some pressure from the energizing side of seal assembly 40 bleeds through or across to the non-energized side of seal assembly 40. If such pressure does bleed through or across the subassembly and causes the opposing load member 18 to move into contact with its respective limit shoulder, the unidirectional seal (or other equalizer) 16*b* on that side will be isolated from the mechanical load path in the same way it was in FIGS. 1 and 2. One of ordinary skill in the art will appreciate the propensity of seal assemblies in dynamic applications to suffer from intermittent burps of pressure during times of linear or rotational motion. These intermittent occasions of pressure bypass can result in a condition known commonly referred to as "pressure trap" between the two halves of subassembly 14. In the case of FIG. 4, it is possible for each load member 18*a* and 18*b* to simultaneously reach its respective limit shoulder on the mandrel 12 in the event of pressure trap between the two halves of subassembly 40; nevertheless in all scenarios both energizers 16*a* and 16*b* are always protected.

Figure 5:
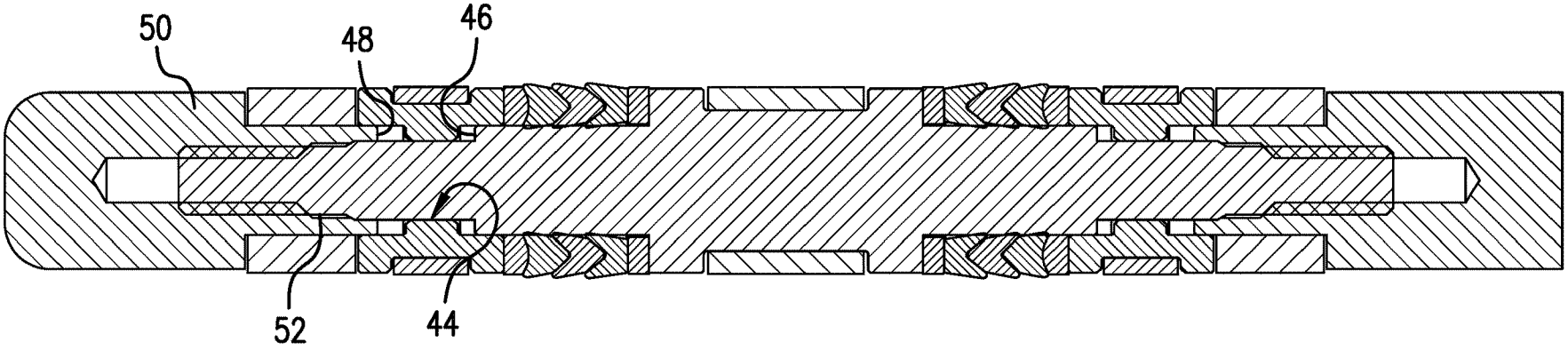
FIG. 5 illustrates an embodiment that includes a two-piece gland and continuous load ring.

Referring to FIG. 5, another embodiment is illustrated that uses a split gland 44 configuration for the load member 18. A split gland 44 employs one side 46 of the gland 44 that is a part of the mandrel 12 and one side 48 of the gland 44 that is on a separate sub 50, that sub 50 being attachable to the mandrel 12 by means of, for example, threads 52. The split gland 44 allows for the use of a single piece load ring 18, which may provide benefit in some applications.

Figure 6A:
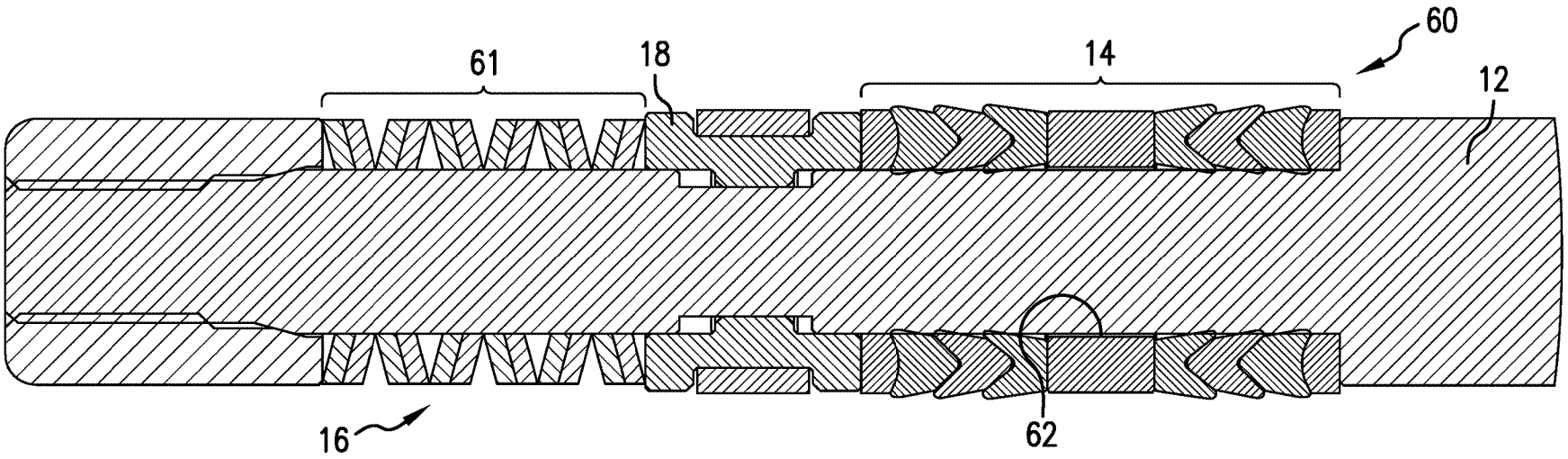
FIGS. 6A-6B illustrates an embodiment wherein the energizer is a spring with the seal assembly shown in a first position and a reverse pressured position.
Figure 6B:
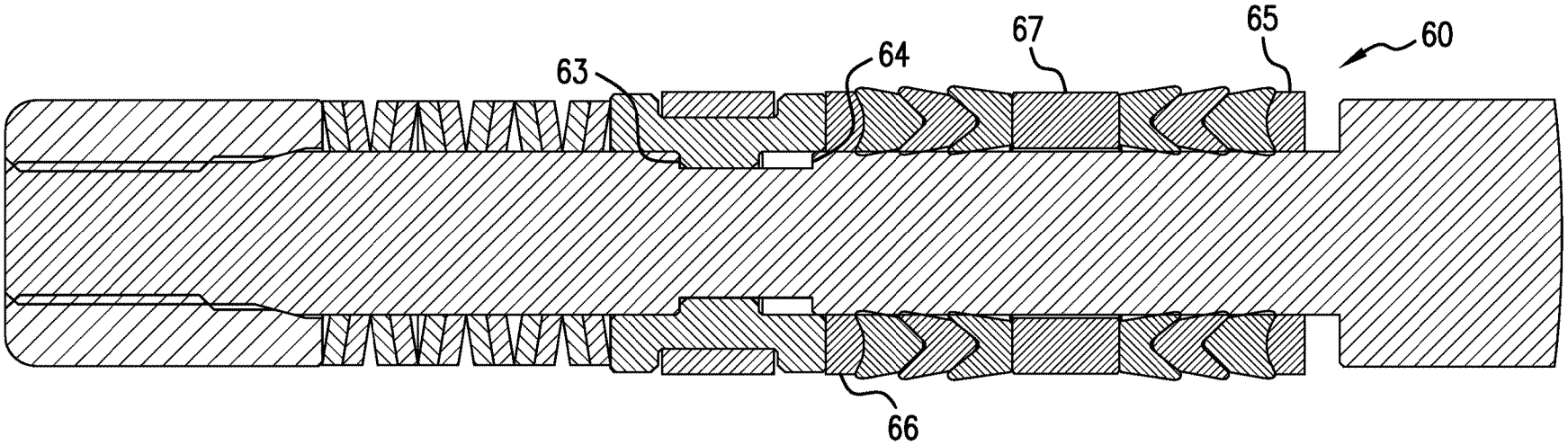

Referring to FIGS. 6A-6B, another embodiment of seal assembly, designated 60, is illustrated wherein the seal subassembly 14 is configured as a bi-directional seal, meaning it is capable of sealing in opposing directions, that is energized in only one direction from a single energizer 16. One of the key benefits of a having a single energizer 16 and a bidirectional seal is a fewer number of components and a shorter overall length of the seal assembly 60 when compared to the embodiments depicted in FIGS. 1, 4, and 5. The seal subassembly 14 is illustrated as a series of reverse facing chevrons with a center adapter 67 in the middle of the stack and an end adapter at each end 65 and 66; however in other embodiments it is contemplated that the subassembly could include, or could be exclusively, a bi-directional elastomeric seal that is energized via squeeze between the gland 62 and a bore of a housing (not shown). As previously mentioned, examples of bi-directional elastomeric seals would include t-seals, o-rings, chevrons, etc. As in the previous Figures, the seal subassembly 14 is configured such that its pressure containing capability is enhanced upon being mechanically energized. In FIGS. 6A-6B, the energizer 16 is depicted as a series of cone washers 61, arranged in a manner as to provide mechanical energizing to effect a seal of the subassembly over a defined distance of travel (i.e. working length of spring). The defined distance of travel is the distance the load member 18 can translate along the mandrel 12 between opposing limit shoulders 63 and 64. Those of ordinary skill in the art will appreciate the suitability of cone washer arrangements for energizing seal assemblies based their ability to generate high loads within a small installation space. Moreover, as the cone washers 61 are of an annular shape, force transmission to the seal subassembly 14 is uniform along the circumference of the seal assembly 60 and concentric to the seal subassembly 14 itself, which is ideal in both cases. Finally, cone washers 61 have a high degree of configurability in parallel, series, or a combination of both, thereby enabling optionality in terms of spring characteristics. When compared with an energizer 16 that is pressure energized (such as a unidirectional seal see 16*a* in FIG. 1, for example), an energizer 16 that is spring energized or magnetically energized will provide a relatively high and relatively constant energizing force that is irrespective of the pressure differential across the energizer 16*a*. The relatively high and relatively constant force output of the spring or magnetic energizers enables improved sealing performance by highly energizing the seal subassembly across all possible pressure differentials. One of ordinary skill in the art will appreciate that seal assemblies intended for downhole service are commonly susceptible to leakage in conditions wherein a low differential pressure exists across the seal. In most conventional pressure energized seal designs, this vulnerability results from the seal being minimally energized in low differential conditions (and as previously mentioned, perhaps damaged by experiencing overloading in the reverse direction) and thus being unable to adequately seal off against the pressure. By comparison, a seal such as the embodiment that is described, with a constantly high energizing force is expected to perform much better in low differential conditions by keeping the seal subassembly properly energized. Finally, in applications where the seal assembly is dynamic in nature (i.e. translating, rotating, etc.), a relatively constant energizing force may be preferable when considering friction with the bore of the housing (not shown). A relatively constant energizing force would result in a relatively constant and more predictable amount of seal friction when compared with an equivalent seal that is pressure energized (thus having variable friction based on the pressure differential across the energizer). Higher predictability enables improvement in the overall design process for seals and downhole tools. While energizer 16 is depicted as a series of cone washers 61, other spring embodiments are also contemplated including those described in connection with other embodiments herein.

Figure 7:
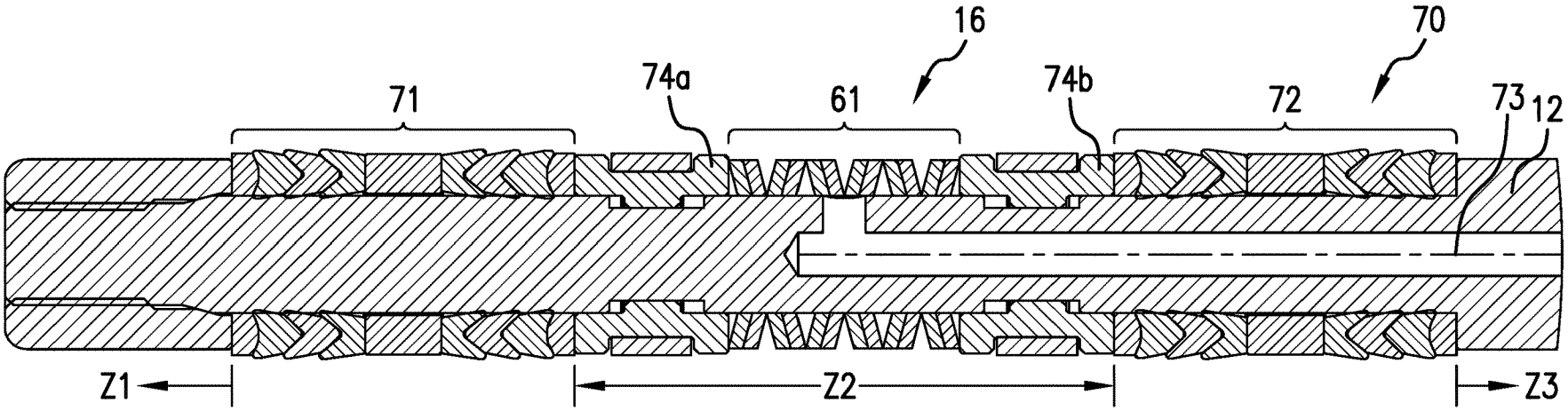
FIG. 7 illustrates an embodiment of a seal assembly with two seal subassemblies energized by a common energizer in opposing directions.

Referring to FIG. 7, another embodiment of seal assembly, designated 70, is illustrated wherein three pressure zones are established by way of two bi-directional seal subassemblies 71 and 72 and an energizer 16 installed upon a mandrel 12. The first pressure zone Z1 is located to the left (in the Figure) of the first seal subassembly 71. The second pressure zone Z2 is located between the first and second seal subassemblies 71 and 72. The third pressure zone Z3 is located to the right (in the Figure) of the second seal subassembly 72. Energizer 16 is depicted as a series of cone washers 61 which is used to energize both seal subassemblies 71 and 72 simultaneously and in opposing directions by applying a spring force evenly to both load members 74*a* and 74*b*. In an alternate embodiment, a plurality of magnets may be arranged between load members 74*a* and 74*b* to produce a collective stroke length using the magnetic field induced stroke of each magnet. A passage 73 is included within the mandrel 12 for fluidly communicating Zone 2 to a different region of the mandrel 12. In one embodiment, the seal assembly 70 is installed upon a mandrel that makes up a portion of a pressure balanced rod piston control system of a subsurface safety valve as taught in U.S. Pat. No. 6,173,785 B1 and embodied in the Reach$_{tm}$ tubing retrievable safety valve commercially available from Baker Hughes, Houston Texas. Further, Zone 2 would represent a portion of the valve's balance line that is used to offset the hydrostatic pressure in the subsurface safety valve's control line, resulting from the setting depth of the valve and the density of the hydraulic fluid selected to operate the valve. In an alternate embodiment, pressure zone 2 could represent a portion of an atmospheric chamber (i.e. a zone filled with air at atmospheric pressure). As in U.S. Pat. No. 6,173,785 B1, Zone 1 would represent a portion of the valve's control line and Zone 3 represents a region of the valve exposed to tubing pressure (i.e. wellbore pressure within the subsurface safety valve). Further, seal assembly 70 would represent a combination of the seals marked 26 and 28 in U.S. Pat. No. 6,173,785 B1. As in previous embodiments, load members 74*a* and 74*b* are independently limited in their travel such that the energizer 16*a* can energize each seal subassembly 71 and 72 in the respective direction of bias of the energizer, while in the reverse direction the energizer is protected from overloading. Each load member 74*a* and 74*b* is individually allowed to translate within its limits, and in the absence of pressure in Zone 1 or Zone 3 each seal subassembly 71 and 72 will be evenly energized by the energizer 16. The current embodiment also allows for a supplemental pressure energizing which imparts additional energizing force on one or both seal subassemblies. Supplemental pressure energizing occurs when, for a limited travel of the load members 74*a* and 74*b*, pressure differential acting against one or both seal subassemblies results in an increased compression of the energizer 16 and a higher energizing load that is imparted to the one or both seal subassemblies as a result.

While FIGS. 1,2, and 4-7 all illustrate embodiments where the recess 22 is on the mandrel 12, the teachings herein are equally applicable to arrangements where the recess 22 is in a structure radially outwardly of the load member(s) 18. This is the case in each of FIGS. 8-13. 200 series numerals of the same numerals used in the above-described embodiments for all similar individual components will be used to indicate similarity to the previous embodiments. Comparison of FIGS. 8-13 with FIGS. 1,2, and 4-7 will ensure correct understanding of the teachings hereof.

Figure 8:
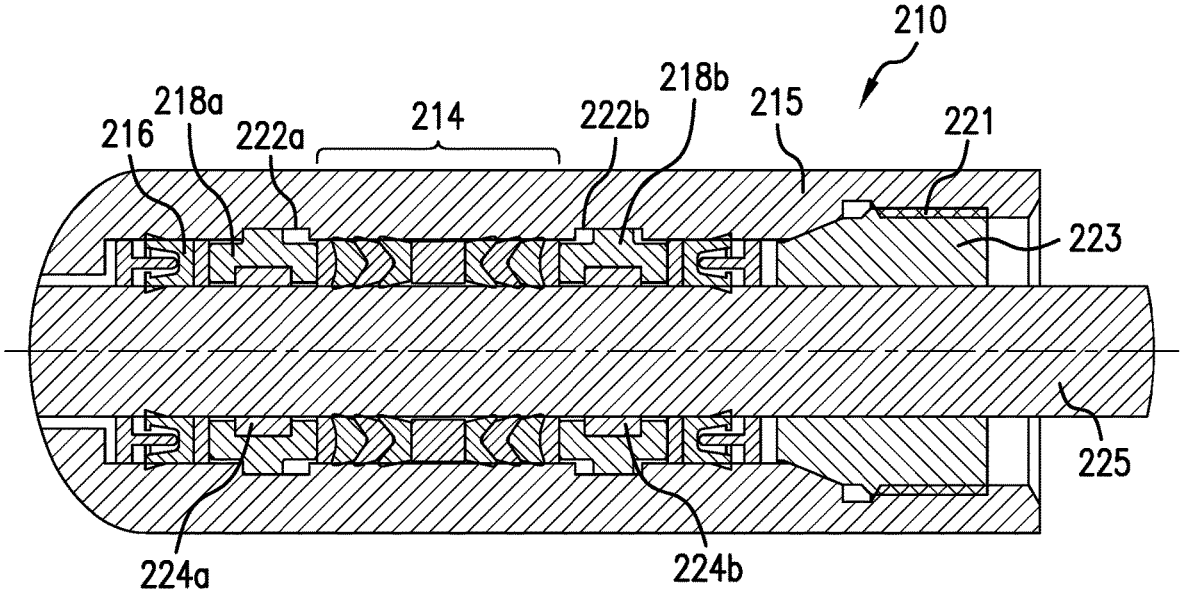
FIGS. 8-9 are inverted embodiments of FIGS. 1 and 2.
Figure 9:
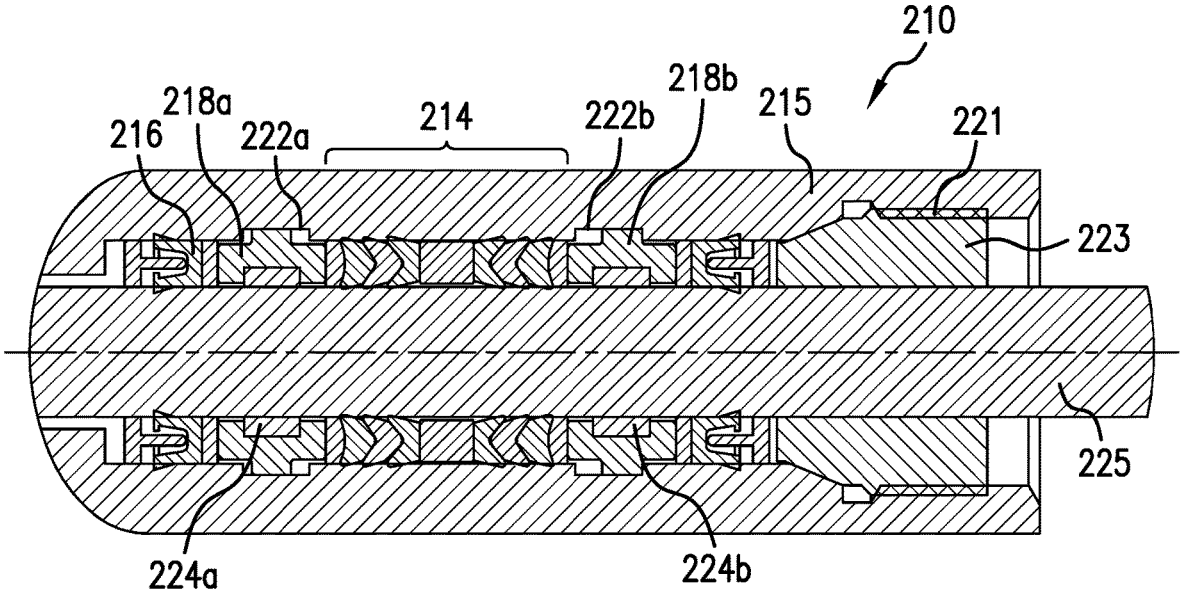

FIGS. 8 and 9 are similar to FIGS. 1 and 2 with the load members 218*a* and *b* shifted left and right respectively of the Figure as in FIGS. 1 and 2. Differences, other than the recesses 222*a* and *b* being radially outwardly of the seal assembly 210 in a housing 215, include that the central member is a rod piston 225 and that the seal assembly uses a retainer 223, depicted as a nut, threaded at thread 221 into housing 215 to retainer the seal arrangement within the housing and transfer pressure induced loading to the housing. In another embodiment, retainer 223 may be of a snap ring construction (e.g. radially outwardly biased C shaped ring) or segmented load ring that is deposited within a groove in housing 215 after energizer 216 is installed. The use of retainer 223 as described is common to all embodiments depicted in FIGS. 8 through 13. As in FIGS. 1 and 2, load members 218*a* and *b* may be segmented, rather than a full ring, to aid in installation. However, in such embodiment the retainer rings 224*a* and *b*, being of a snap ring construction, would be installed internally within the load members 218*a* and *b* rather than externally as in FIGS. 1 and 2. As shown in FIGS. 8 and 9, retainer rings 224*a* and *b* may install within an inward profile of the load members 218*a* and *b* to align the load members longitudinally in the form of a continuous ring and expand the load members outwardly towards the recess 222*a* and *b*. In another embodiment, load members 218*a* and *b* may themselves be of snap ring construction with a radially outwardly bias such that retainer rings 224*a* and *b* are no longer necessary. Outside of the mentioned differences, the seal assembly 210 otherwise functions identically to that of FIGS. 1 and 2.

Figure 10:
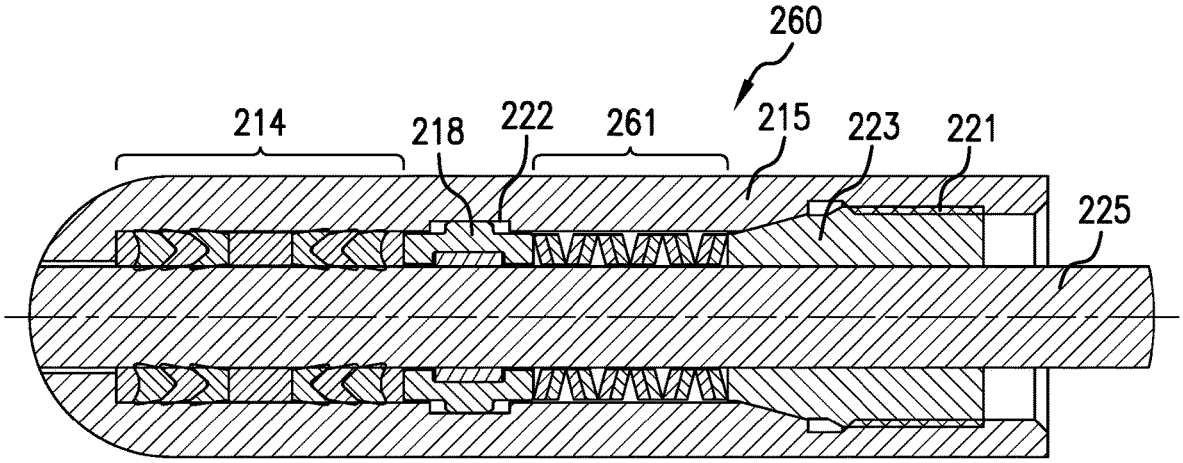
FIGS. 10 and 11 are inverted embodiments of FIGS. 6A and 6B.
Figure 11:
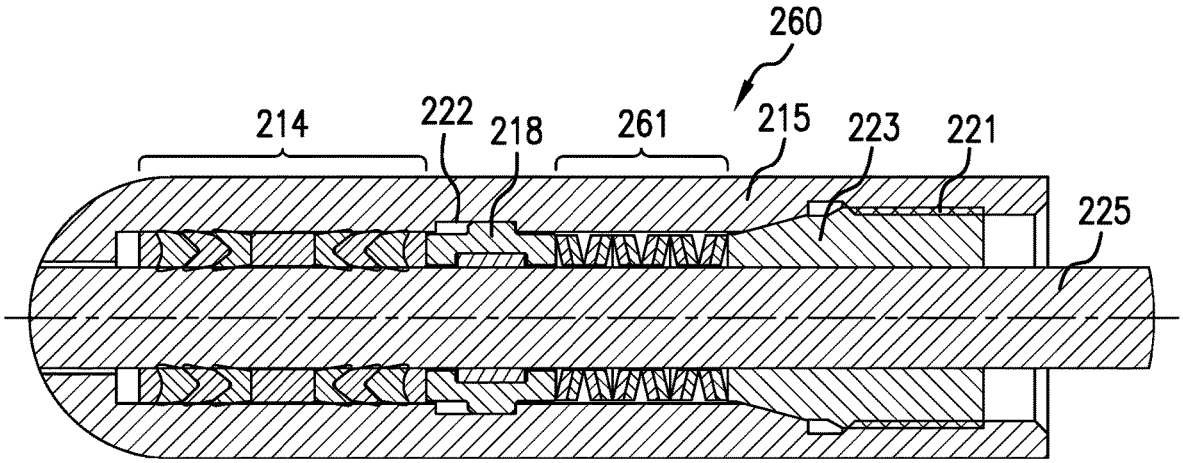

Referring to FIGS. 10 and 11, illustrated are two positions of another embodiment that is similar to FIGS. 6*a* and 6*b* but modified to dispose the recess 222 radially outwardly of the seal assembly 260 in the housing 215. This embodiment, like that of FIGS. 8 and 9, uses a rod piston central member 225. Different than that of FIGS. 6*a* and 6*b*, seal subassembly 214 is energized by energizer 261 after first being installed within the piston bore that is contained in housing 215. This order of operations for the assembly sequence allows the seal subassembly 214 to be installed within the piston bore in a non-energized condition, resulting in an easier installation due to the reduced interference of the seal subassembly with the piston bore upon installation (as compared with a seal subassembly that is mechanically energized prior to its insertion within the bore, which increases its radial cross section and its interference with the bore I.D.). The reduced interference also lowers the probability of damaging elements of the seal subassembly (e.g. clipping or rolling a vee ring) during the installation process and thereby improves reliability. Finally, the assembly sequence as described also allows a comparatively greater energizing force to be applied by energizer 261 without fear of being unable to install the seal assembly within the bore, for the mentioned reasons.

Figure 12:
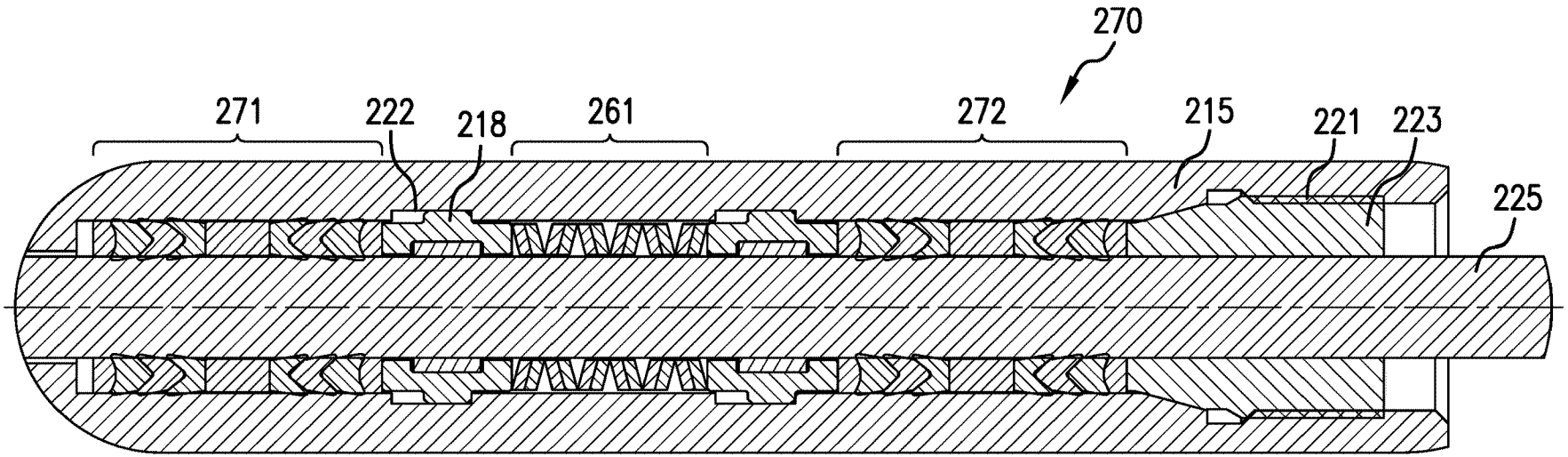
FIGS. 12 and 13 are inverted embodiments of FIG. 7.

Referring to FIG. 12, an embodiment similar to FIG. 7 is illustrated. The embodiment of a seal assembly 270 again positions the recess 222 radially outwardly of the seal assembly 270 in the housing 215. The central member is a rod piston 225 and that the seal assembly uses a nut 223 threaded at thread 221 into housing 215. Same as FIGS. 10 and 11, seal subassembly 271 and 272 are energized by energizer 261 and nut 223 after first being installed within the piston bore contained in housing 215 in a non-energized condition. Thus, the mentioned benefits of such order of operations are likewise shared in this embodiment. Outside the mentioned differences, the embodiment otherwise functions identically to that of FIG. 7.

Figure 13:
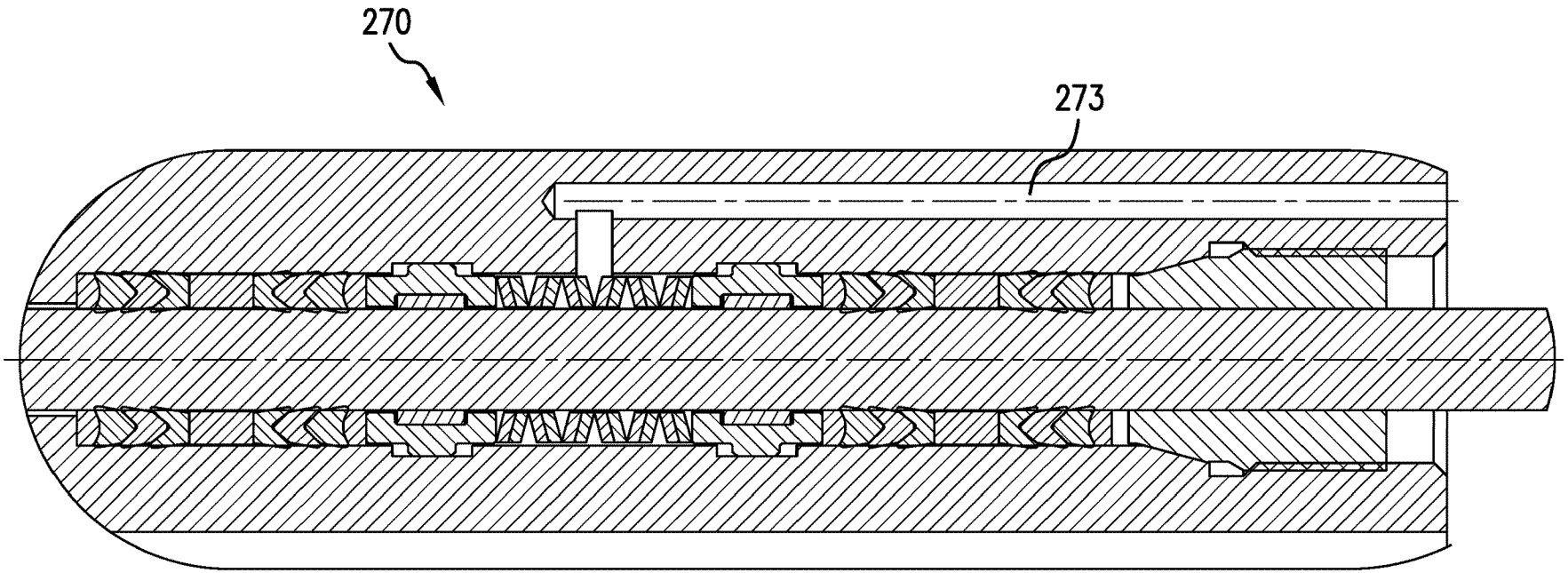

Referring to FIG. 13, the same configuration as FIG. 12 is employed but a pressure conduit 273 is added to housing 215 for tubing pressure insensitive uses. This is also similar to FIG. 7 since that figure includes a conduit 73 for the same purpose but in the mandrel 12 as opposed to the housing 215.

Figure 14:
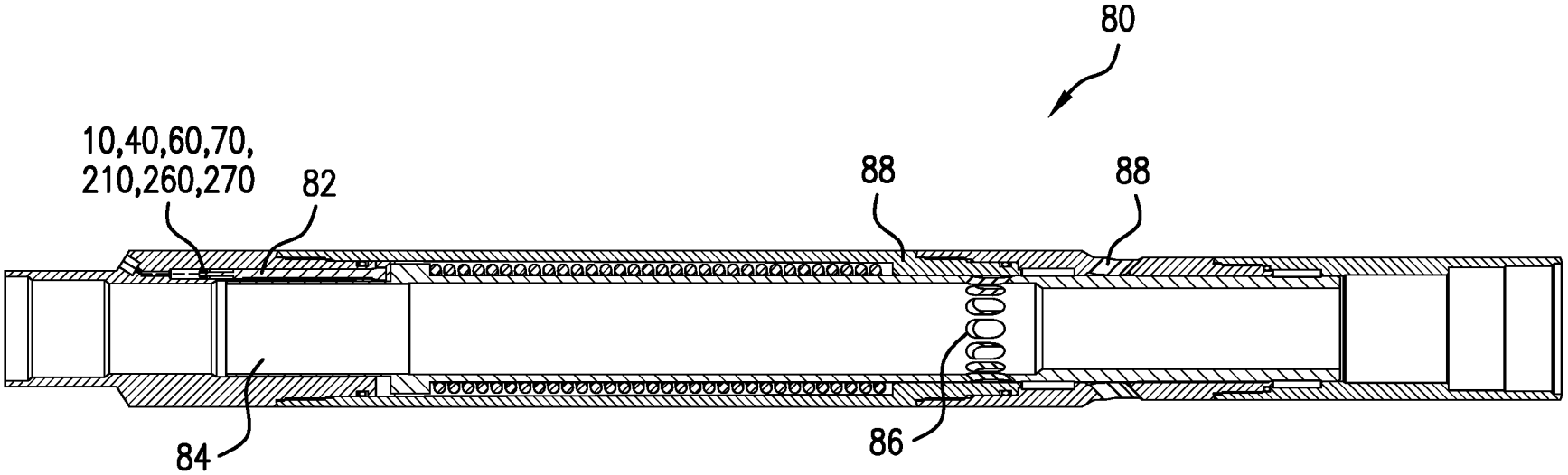
FIG. 14 is a view of a downhole tool employing the seal assembly disclosed herein.

Referring to FIG. 14, a downhole tool 80 is illustrated that uses the seal assembly 10, 40, 60, 70, 210, 260 and 270 on a rod piston actuator 82. The tool 80 includes a sleeve 84, that may be a sliding sleeve, having ports 86. The sleeve 84 is movable in a housing 88 such that the ports 86 are aligned with openings 88 or misaligned with openings 88. The tool has a greater reliability and service life since the energizers 16 used therein do not become reverse mechanically loaded upon pressure reversal thereon.

Figure 15:
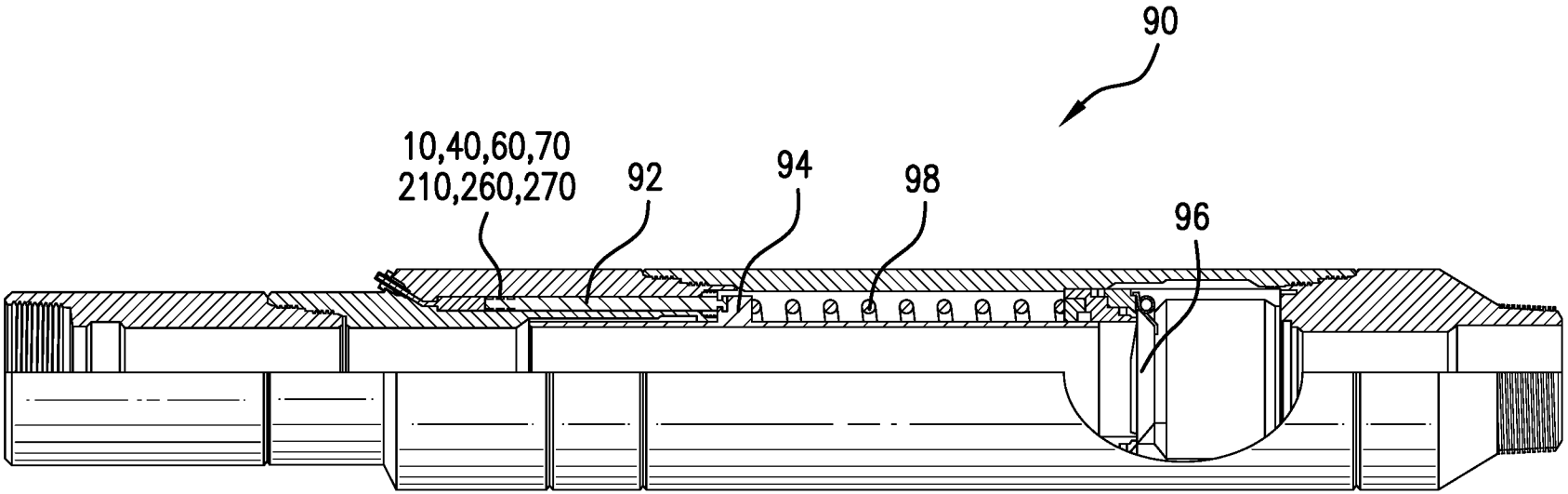
FIG. 15 is another downhole tool employing the seal assembly as disclosed herein.

Referring to FIG. 15, another downhole tool 90 is illustrated that uses the seal assembly 10, 40, 60, 70, 210, 260 and 270 as disclosed herein. The tool 90 uses a rod piston actuator 92, upon which the seal assembly 10, 40, 60, 70, 210, 260 and 270 is disposed to actuate a flow tube 94. Upon actuation of the flow tube 94, a flapper 96 may be forced to an open position by the flow tube 94. The flow tube may return to a position wherein the flapper 86 is closed based upon the energy of a power spring 98. Due to the seal assembly 10, 40, 60, 70, 210, 260 and 270 as disclosed herein, reverse mechanical loading of the energizers 16 is avoided and hence reliability of the downhole tool 90 is improved.

Figure 16:
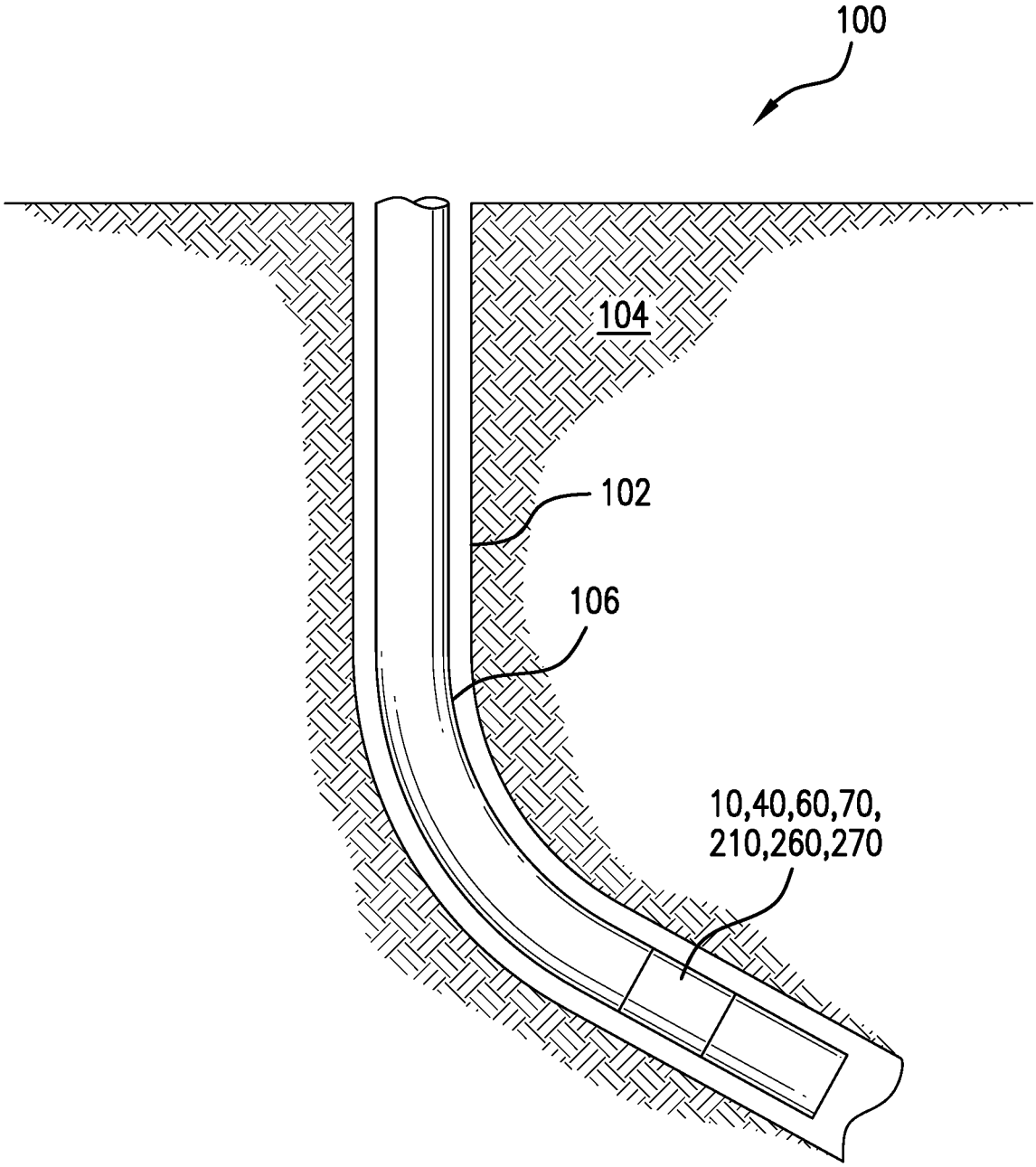
FIG. 16 is a view of a wellbore system including the seal assembly disclosed herein.

Referring to FIG. 16, a wellbore system 100. The system 100 includes a borehole 102 in a subsurface formation 104. A string 106 is disposed in the borehole 102. A downhole tool that includes the seal assembly 10, 40, 60, 70, 210, 260 and 270 as disclosed herein is disposed in or as a part of the string 106.

Set forth below are some embodiments of the foregoing disclosure:

Embodiment 1: A seal assembly including a seal subassembly configured to hold pressure, a first load member having a first side disposed adjacent a first side of the seal subassembly, the first load member configured to engage a recess in one of a central member radially inwardly of the seal subassembly or a housing radially outwardly of the seal subassembly such that the first load member independently has a limited axial movement capability in both longitudinal directions along the seal assembly, and a first energizer adjacent a second side of the first load member, the first load member isolating the first energizer from mechanical loading in a direction opposite a direction of bias of the first energizer.

Embodiment 2: The seal assembly as in any prior embodiment further including a second load member having a first side adjacent a second side of the seal subassembly, the second load member configured to engage the central member or housing such that the second load member independently has a limited axial movement capability in both longitudinal directions along the seal assembly, and a second energizer adjacent a second side of the second load member, the second load member isolating the second energizer from mechanical loading in a direction opposite a direction of bias of the second energizer.

Embodiment 3: The seal assembly as in any prior embodiment wherein the subassembly is mechanically energized by the first energizer in a direction of bias of the first energizer.

Embodiment 4: The seal assembly as in any prior embodiment wherein the subassembly is mechanically energized by the second energizer in a direction of bias of the second energizer.

Embodiment 5: The seal assembly as in any prior embodiment wherein the seal subassembly includes chevron elements.

Embodiment 6: The seal assembly as in any prior embodiment wherein at least a portion of the seal subassembly is axially fixed to the central member or housing.

Embodiment 7: The seal assembly as in any prior embodiment wherein the first energizer comprises a unidirectional seal.

Embodiment 8: The seal assembly as in any prior embodiment wherein the first energizer is a spring configuration.

Embodiment 9: The seal assembly as in any prior embodiment wherein the first energizer is a magnet arrangement.

Embodiment 10: The seal assembly as in any prior embodiment wherein the magnet arrangement is a plurality of magnets arranged to produce a collective stroke length using a magnetic field induced stroke of each magnet.

Embodiment 11: The seal assembly as in any prior embodiment wherein the first load member is a multipart ring.

Embodiment 12: The seal assembly as in any prior embodiment, further comprising a sub that is attached to the mandrel to create a gland receptive of the first load member and the first load member is a circumferentially complete ring.

Embodiment 13: The seal assembly as in any prior embodiment wherein the central member or housing includes a recess receptive to a portion of the first load member.

Embodiment 14: The seal assembly as in any prior embodiment wherein the central member is a rod piston.

Embodiment 15: The seal assembly as in any prior embodiment wherein the central member is an annular piston.

Embodiment 16: The seal assembly as in any prior embodiment further comprising: a second seal subassembly disposed on the central member or housing, wherein the first energizer energizes the seal subassembly and the second seal subassembly in opposing directions.

Embodiment 17: The seal assembly as in any prior embodiment wherein the central member or housing contains an internal passage extending into fluid communication with the first energizer.

Embodiment 18: The seal assembly as in any prior embodiment wherein the seal subassembly is energized by the first energizer and a retainer after installation of the subassembly into the housing.

Embodiment 19: A downhole tool including a housing, and an actuator disposed in the housing, the actuator including a seal assembly as in any prior embodiment.

Embodiment 20: The tool as in any prior embodiment further including a sleeve disposed in operable contact with the housing and actuatable by the actuator.

Embodiment 21: The tool as in any prior embodiment further including a flow tube disposed in operable contact with the housing and actuatable by the actuator.

Embodiment 22: The tool as in any prior embodiment further including a flapper in operable contact with the flow tube.

Embodiment 23: A wellbore system including a borehole in a subsurface formation, a string disposed in the borehole, and a downhole tool disposed within or as a part of the string and including the seal as in any prior embodiment.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A dynamic seal assembly comprising:

a seal subassembly configured to hold pressure;

a first load member having a first side disposed adjacent a first side of the seal subassembly, the first load member including a radially projection configured to engage a recess in one of a central member radially inwardly of the seal subassembly or a housing radially outwardly of the seal subassembly such that the first load member independently has a limited axial movement capability in both longitudinal directions along the seal assembly, while the seal assembly is in a sealed condition as a dynamic seal; and a first energizer adjacent a second side of the first load member, the first load member isolating the first energizer from mechanical loading in a direction opposite a direction of bias of the first energizer.

2. The seal assembly as claimed in claim 1 further comprising:

a second load member having a first side adjacent a second side of the seal subassembly, the second load member configured to engage the central member or housing such that the second load member independently has a limited axial movement capability in both longitudinal directions along the seal assembly; and a second energizer adjacent a second side of the second load member, the second load member isolating the second energizer from mechanical loading in a direction opposite a direction of bias of the second energizer.

3. The seal assembly as claimed in claim 1 wherein the subassembly is mechanically energized by the first energizer in a direction of bias of the first energizer.

4. The seal assembly as claimed in claim 1 wherein the subassembly is mechanically energized by the second energizer in a direction of bias of the second energizer.

5. The seal assembly as claimed in claim 1 wherein the seal subassembly includes chevron elements.

6. The seal assembly as claimed in claim 1 wherein at least a portion of the seal subassembly is axially fixed to the central member or housing.

7. The seal assembly as claimed in claim 1 wherein the first energizer comprises a unidirectional seal.

8. The seal assembly as claimed in claim 1 wherein the first energizer is a spring configuration.

9. The seal assembly as claimed in claim 1 wherein the first energizer is a magnet arrangement.

10. The seal assembly as claimed in claim 9 wherein the magnet arrangement is a plurality of magnets arranged to produce a collective stroke length using a magnetic field induced stroke of each magnet.

11. The seal assembly as claimed in claim 1 wherein the first load member is a multi-part ring.

12. The seal assembly as claimed in claim 1, further comprising a sub that is attached to a mandrel to create a gland receptive of the first load member and the first load member is a circumferentially complete ring.

13. The seal assembly as claimed in claim 1 wherein the central member or housing includes a recess receptive to a portion of the first load member.

14. The seal assembly as claimed in claim 1 wherein the central member is a rod piston.

15. The seal assembly as claimed in claim 1 wherein the central member is an annular piston.

16. The seal assembly as claimed in claim 1 further comprising a second seal subassembly disposed on the central member or housing, wherein the first energizer energizes the seal subassembly and the second seal subassembly in opposing directions.

17. The seal assembly as claimed in claim 1 wherein the central member or housing contains an internal passage extending into fluid communication with the first energizer.

18. The seal assembly as claimed in claim 1 wherein the seal subassembly is energized by the first energizer and a retainer after installation of the subassembly into the housing.

19. A downhole tool comprising;

a housing; and an actuator disposed in the housing, the actuator including a seal assembly as claimed in claim 1.

20. The tool as claimed in claim 19 further including a sleeve disposed in operable contact with the housing and actuatable by the actuator.

21. The tool as claimed in claim 19 further including a flow tube disposed in operable contact with the housing and actuatable by the actuator.

22. The tool as claimed in claim 21 further including a flapper in operable contact with the flow tube.

23. A wellbore system comprising:

a borehole in a subsurface formation;

a string disposed in the borehole; and a downhole tool disposed within or as a part of the string and including the seal as claimed in claim 1.

* * * * *